US006527054B1

(12) United States Patent
Fincher et al.

(10) Patent No.: US 6,527,054 B1
(45) Date of Patent: Mar. 4, 2003

(54) APPARATUS AND METHOD FOR THE DISPOSITION OF DRILLING SOLIDS DURING DRILLING OF SUBSEA OILFIELD WELLBORES

(75) Inventors: Roger W. Fincher, Conroe; Peter Fontana, Houston, both of TX (US)

(73) Assignee: Deep Vision LLC, Houston, TX (US)

( * ) Notice: Subject to any disclaimer, the term of this patent is extended or adjusted under 35 U.S.C. 154(b) by 2 days.

(21) Appl. No.: 09/661,734

(22) Filed: Sep. 14, 2000

Related U.S. Application Data

(60) Provisional application No. 60/153,771, filed on Sep. 14, 1999.

(51) Int. Cl.[7] ..... E21B 7/12

(52) U.S. Cl. ..... 166/357; 166/358; 137/544

(58) Field of Search ..... 175/5–7, 88, 206, 175/207, 217; 166/350, 357, 358, 367, 368; 137/544

(56) References Cited

U.S. PATENT DOCUMENTS 4,134,461 A * 1/1979 Blomsma
4,149,603 A * 4/1979 Arnold
4,813,495 A * 3/1989 Leach
5,361,998 A 11/1994 Sirevag et al. ..... 241/79.1
5,564,509 A * 10/1996 Dietzen
6,216,799 B1 * 4/2001 Gonzales
6,263,981 B1 * 7/2001 Gonzales

FOREIGN PATENT DOCUMENTS

WO WO 89/09091 10/1989
WO WO 99/15758 4/1999

* cited by examiner

*Primary Examiner*—Roger Schoeppel
(74) *Attorney, Agent, or Firm*—Madan, Mossman & Sriram, P.C.

(57) ABSTRACT

This invention provides apparatus and methods for controlling the particle size of the solid mass present in the circulating drilling fluid returning from an underwater wellhead during the drilling of a subsea wellbore. The system may include a separator at the sea floor adjacent the wellhead, which separates solids above a predetermined size from the wellstream. The wellstream then enters one or more underwater pumps, which pump the wellstream to the surface. A crusher, as a separate unit, integrated in the separator or in the pump, receives the separated solids and reduces them to relatively small-sized particles. The small particles are then pumped or moved to the surface by the pumps utilized for pumping the wellstream to the surface or by a separate underwater pump. Alternatively, the separated solids are collected from the separator into a container, which container is then transported to the surface by a suitable method. Solids reaching the surface are removed to obtain filtered fluid, which after conditioning by conventional methods is pumped back into the wellbore as the drilling fluid.

39 Claims, 4 Drawing Sheets

APPARATUS AND METHOD FOR THE DISPOSITION OF DRILLING SOLIDS DURING DRILLING OF SUBSEA OILFIELD WELLBORES

CROSS REFERENCE

This application takes priority from U.S. patent application Ser. No. 60/153,771, filed Sep. 14, 1999.

BACKGROUND OF THE INVENTION

1. Field of the Invention

This invention relates generally to drilling of oilfield wellbores and more particularly to apparatus and method for processing (separation, resizing and/or disposition) at the sea floor at least a portion of solids returning with the drilling fluid to the sea floor wellhead during drilling of subsea wellbores.

2. Description of Related Art

Oilfield wellbores or boreholes are drilled by rotating a drill bit attached to the bottom of a drill string. The drill bit is rotated by rotating the entire drill string from the surface and/or by a drilling motor (also referred to in the oil and gas industry as the "mud motor") disposed in a bottomhole assembly attached to the drill bit. In either case, a drilling fluid, which is usually a mixture of water or oil and various additives (commonly referred to as the "mud") is supplied under pressure from a source thereof at the surface into the drill string tubing, which may be a jointed pipe or coiled tubing.

In drilling subsea wellbores, the drilling fluid passes through the tubing, bottomhole assembly and drilling motor (when used) and discharges at the drill bit bottom. The drilling fluid discharging at the wellbore bottom and then returning to the wellhead at the sea floor via the annular space (the "annulus") between the drill string and the wellbore wall. The rock disintegrated by the drill bit rotation (commonly referred to as the "cuttings" or the "drill cuttings") is carried to the subsea wellhead by the returning drilling fluid via the annulus. Additionally, solids may enter into the returning drilling fluid due to caving of the rock along the drilled wellbore. Solids may also be present in the form of metal cuttings due to cutting of holes in metallic pipes to form junctions for drilling lateral wellbores or in the form of chunks of cement dislodged from completed or partially completed sections of the wellbore. The returning drilling fluid carrying the above-described solids is sometimes referred to herein as the "return fluid" or "wellstream."

During drilling of certain types of subsea wellbores, such as dual gradient type, solids in the fluid returning to the wellhead at the sea floor must be properly managed. In certain subsea applications, the return fluid is pumped to the surface by pumps at the sea floor. These pumps can allow passage of solids of up to a certain size and hardness without being damaged. The solids, however, can vary greatly in size and hardness, with some solids being greater in size than the pump specifications. Unless the oversized solids are first removed or resized, they can plug or damage the pumps. Replacing pumps in deep sea drilling operations can be very expensive.

Thus, the subsea pumps must be protected from plugging or damage caused by the impact of the drilling fluid solids on the internal parts of the pumps. Particle impact, depending upon the size, hardness, and density of the solids, can gradually erode the pumps, cause catastrophic failures, or plug the pumps.

The present invention addresses the above-noted problems and provides apparatus and methods for processing the return fluid including separating solids, resizing solids and transporting the fluid to the surface without plugging or damaging the subsea pumps.

SUMMARY OF THE INVENTION

The present invention provides apparatus and methods for processing of drilling fluid returning to the wellhead in subsea drilling operations. In one aspect, the invention provides apparatus and methods for controlling the particle size of the solid mass present in the circulating drilling fluid returning to the subsea wellhead during drilling of a subsea wellbore. The system includes a separator at the sea floor adjacent the wellhead, which separates solids above a predetermined size from the return fluid. The subsea separator may be a mechanical separator, a hydrocyclone-type separator or any other type of separator judged suitable for the task. The return fluid from the separator enters into one or more subsea pumps, which pump the fluid to the surface. A crusher or pulverizer, either integrated in the separator or as a separate unit, receives the separated solids and reduces them to relatively small-sized particles. The small particles are then pumped to the surface by subsea pump(s) which may be the same pumps utilized for pumping the return fluid to the surface or separate subsea pumps. Alternatively, the separated solids may be collected from the separator into a container. The container is then transported to the surface by a suitable method. Alternatively, filtered drilling fluid may be used to lift the collected solids to the surface. In an alternative system, the return fluid may be passed directly to a crusher that reduces the particle size of the larger solids. The fluid and the small solids are then pumped to the surface. The crusher and the pump may be integrated into a common unit or may be separate serially arranged units. Solids in the wellstream reaching the surface are filtered or removed by conventional methods. The filtered fluid is conditioned to obtain the desired drilling fluid properties. This conditioned fluid is pumped back into the wellbore as the drilling fluid.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiments taken in conjunction with the accompanying drawings, in which like elements have been given like numerals, and wherein.

DETAILED DESCRIPTION OF THE PREFERRED EMBODIMENTS

Figures 1, 2:
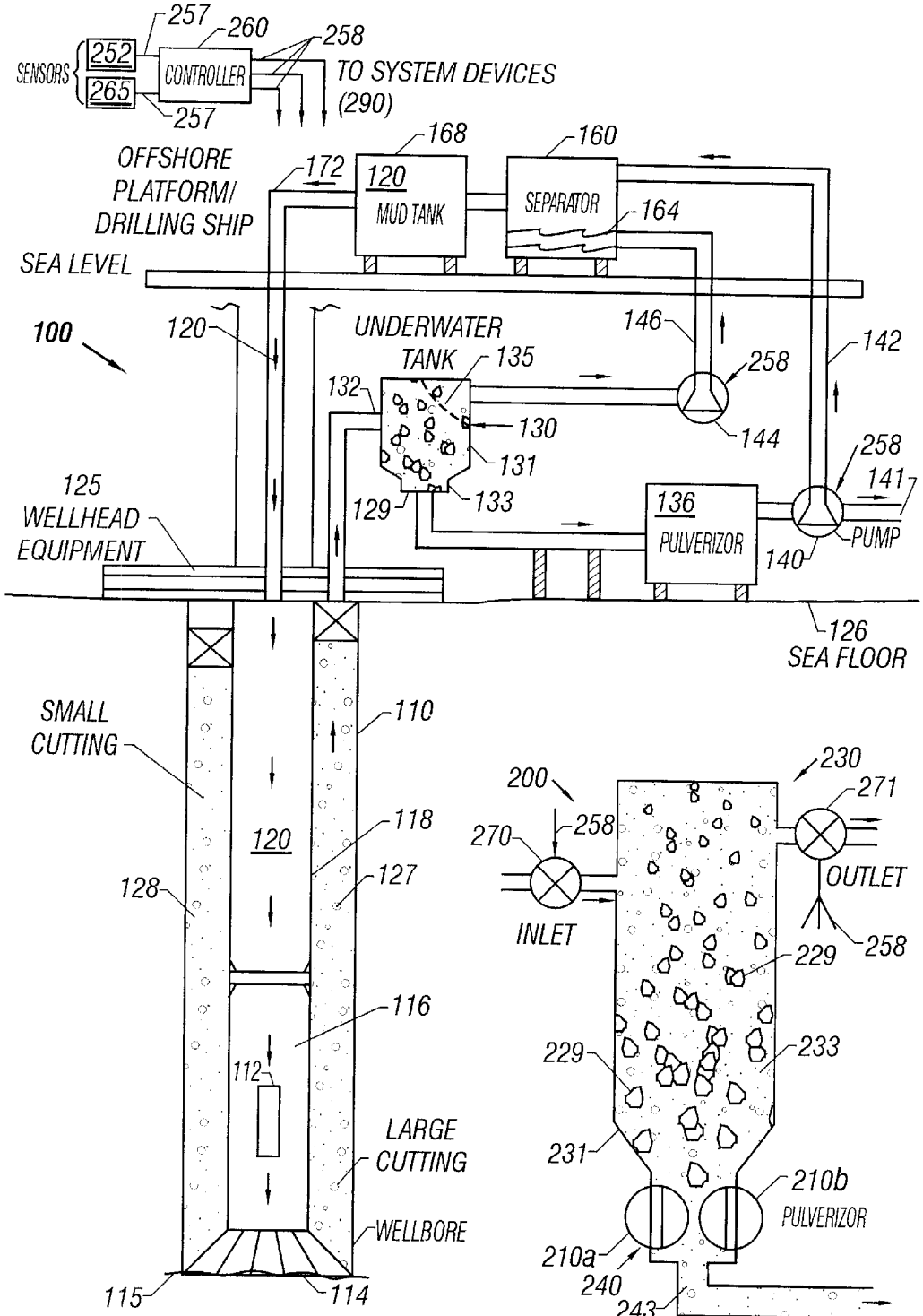
FIG. 1 is a schematic diagram of a system for the processing and disposition of solids received at the wellhead with the circulating drilling fluid during drilling of a subsea wellbore according to one aspect of the present invention.
FIG. 2 is a schematic diagram of an underwater separator with a pulverizer for reducing the size of solids contained in the drilling fluid returning to the underwater wellhead.

FIG. 1 shows a schematic diagram of a system 100 for controlling the particle size of solids in the circulating drilling fluid received at the wellhead on the sea floor during drilling of a subsea wellbore according to one embodiment of the present invention. FIG. 1 shows a wellbore 110 being drilled by rotating a drill bit 114 attached to the bottom of a drilling assembly or bottomhole assembly 116, which is attached to the bottom end of a tubing 118 conveyed from a rig or workstation 162 at the surface. To drill the wellbore 110, the drill bit 114 is rotated by rotating the tubing 118 (if jointed pipes are used to make up the tubing) and/or by a mud motor 112 disposed in the drilling assembly 116. The rotating drill bit 114 disintegrates the rock and produces rock debris 127 (commonly referred to as the "drill cuttings" or the "cuttings") of various sizes. A drilling fluid 120 is pumped or supplied under pressure to the tubing 118 from a mud pit or tank 168 via a line 172. The drilling fluid 120 discharges at the drill bit bottom 116 and returns to the wellhead 125 via the annulus 128. The drilling fluid 120 carries solids 127, such as the drill cuttings, rocks entering the wellstream due to the caving of wellbore sections, and metal pieces left in the wellbore due to the cutting of drill pipe or metals in the wellbore, for example, remaining from construction of lateral wellbores, and loose cement chunks left in the wellbore during cementing of portions of the wellbore 110.

Still referring to FIG. 1, the drilling fluid 120 returns to the wellhead 125 via the annulus 128 and discharges via an inlet port 132 into a fluid/solid separator 130 suitably placed at the sea bottom adjacent the wellhead 125. The larger/heavier solids 129 are separated by the separator 130 and settle at the bottom section 133 of the separator 130 from where they are discharged or moved into a device 136 (such as a crusher of a pulverizer) which reduces the solids 129 received from the separator 130 into solids of sizes smaller than a predetermined size, which is small enough to be pumped to the surface by a pump 140 via a line 142. The term crusher is used herein in the generic sense to mean a suitable subsea device that can be used to reduce the size of solids returning with the return drilling fluid. The device 136 preferably is a crusher type or shear type device or any other suitable device, and may be remotely operable from the surface with the use of controller 260 as discussed below. The device 136 is referred herein as a crusher or pulverizer but means any suitable device that can be used for the intended purpose. Alternatively, the solids 129 from the separator 130 may be deposited on the sea floor 126 after reducing their size, as shown by line 141 or without reducing their size. The separator 130 may be a mechanical separator, a centrifuge type or any other suitable separator that is capable of separating solid mass larger than a predetermined size and/or density from the return fluid.

Relatively small solids remain in the return fluid above the larger solids 129 in the separator 130. The return fluid with the small solids is pumped to the surface by a suitable pump 144 via a fluid line 146. The fluid with small size solids from the separator 130 and the crusher 136 is passed into a solid-water separator 160 at the rig platform 162, which may be a vessel, jack-up rig or a semi-submersible rig. The separator 160 may be any suitable separator utilized in the oil and gas industry and may include a mechanical shaker with one or more screens 164 that filter solids from the fluid in the separator 160. The filtered fluid is discharged into the mud tank 168. The fluid 120 in the mud tank 168 is treated with appropriate additives to obtain the required type of mud and is pumped back into the drill string 112 via line 172. Solids recovered by the surface separator 160 are disposed appropriately.

The subsea separator 130 controls the maximum particle size and/or density of the solids entering into the subsea pump 144. This may be achieved by appropriately selecting the separator 130. In the separator 130 of FIG. 1, the separator body has a conical lower section 131 to collect the larger/heavier solids due to gravity and may include one or more screens in the separator 130, such as screen 135, to prevent passage of solid particle sizes that can damage the subsea pump 144. For the purpose of this invention, any separator or method may be utilized to prevent passage of large particle sizes from entering the pump 144. FIG. 1 shows a novel crusher according to one embodiment of the present invention. Thus, the system shown in FIG. 1 resizes larger solid particles from the return fluid and either pumps the reduced sized particles to the surface or discharges them at the sea floor. A separate pump is used to pump the filtered drilling fluid at the sea floor and for pumping the crushed solids to the surface. This system ensures that only solids smaller than the pump specification size pass through the pumps.

Figure 4:
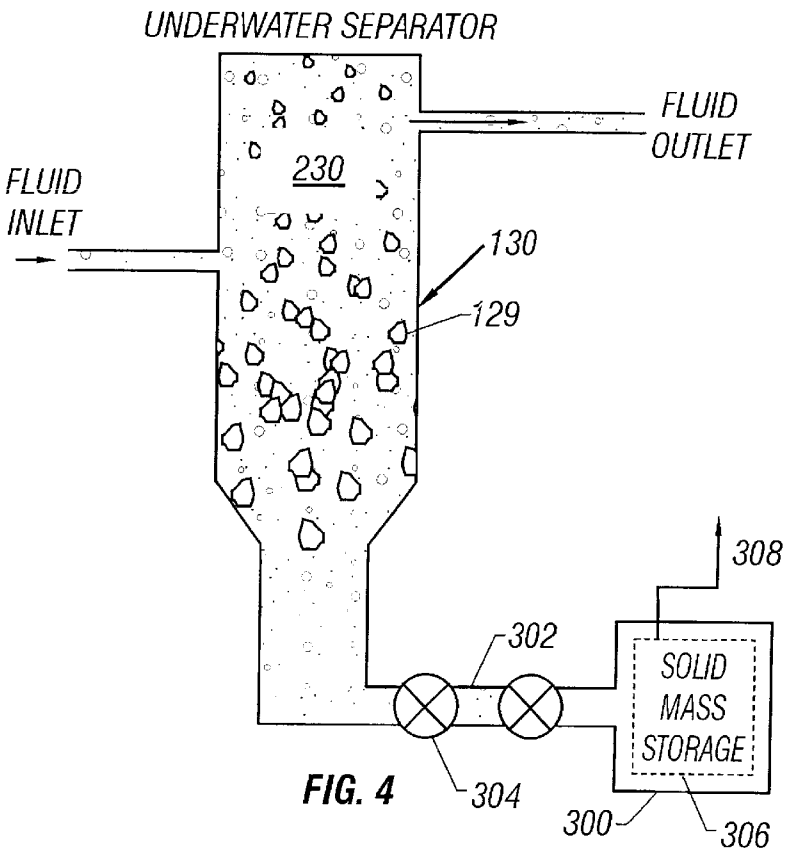
FIG. 4 is a schematic diagram of a system at the sea floor wherein large solids separated from the wellstream by a separator are collected in a container that can be transported to the surface.
Figure 3:
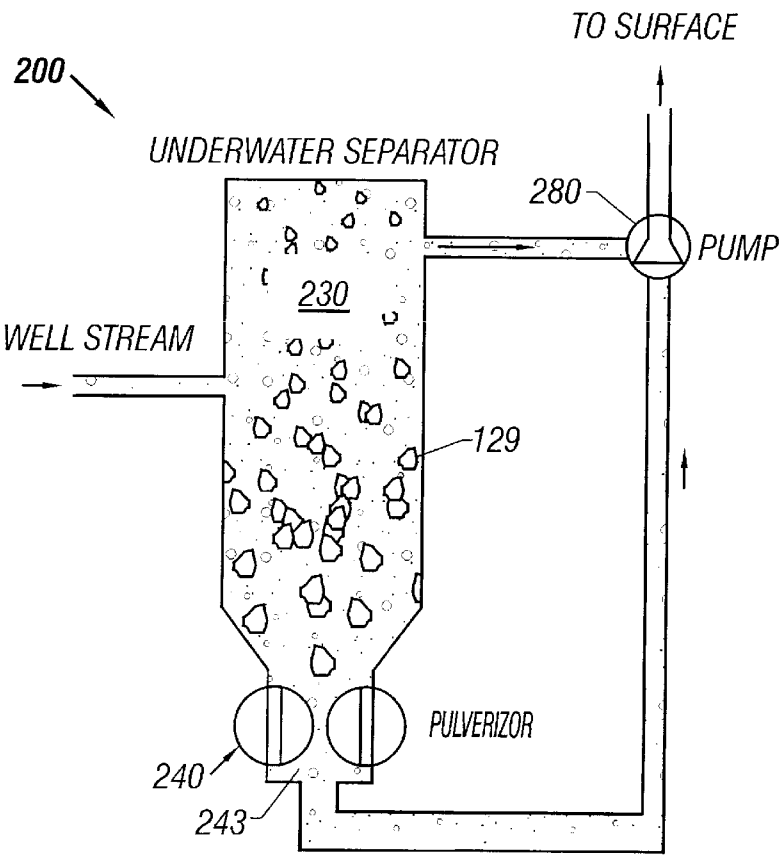
FIG. 3 is a schematic diagram of a system wherein a common subsea pump is utilized to pump to the surface the filtered drilling fluid from the underwater separator and also for transporting pulverized or crushed solids.

FIG. 2 shows a solid-fluid separator 200 with an integrated pulverizer. The separator 200 includes a separator section 230 which is substantially similar to the separator 130 of FIG. 1, but also includes a pulverizer section 240 at the bottom of the conical section 231. The pulverizer section 240 includes a plurality of cooperating crushers 210*a*–210*b* at the bottom of the conical section 231 of the separator 200. The solid mass 229 drops or passes to the crushers 210*a*–210*b*, which reduce such solids to particle sizes below a predetermined size. The discharge 243 from the crusher section 240 which includes drilling fluid mixed with small solid particles is disposed in the manner described above with reference to FIG. 1. The discharge 243 from the integrated separator and pulverizer 200 or the separate crusher 136, shown in FIG. 1, may be pumped by the pump 140 (see FIG. 1). The wellstream from the separator 230 and the discharge 243 from the pulverizer 240 may also be pumped to the surface 162 by a common pump 280, as shown in FIG. 3. In another aspect of the present invention, as illustrated in FIG. 4, the solid mass 129 from the separator 130 of FIG. 1 may be discharged into a transportable solid mass storage unit 300 via line 302. The solid mass 129 from the separator 130 is moved into the storage unit 300 by a suitable mass-moving device 304 such as a screw-type device or a conveyor. Once the solid mass storage unit 300 is full, it is disconnected from the line 302 and transported to the surface. A replacement mass storage unit is then attached to collect solids from continued drilling operation. Alternatively, the solid mass 129 may be collected in removable liners 306 in the storage unit 304, which liners are retrieved and brought to the surface via a suitable line 308.

Figure 5:
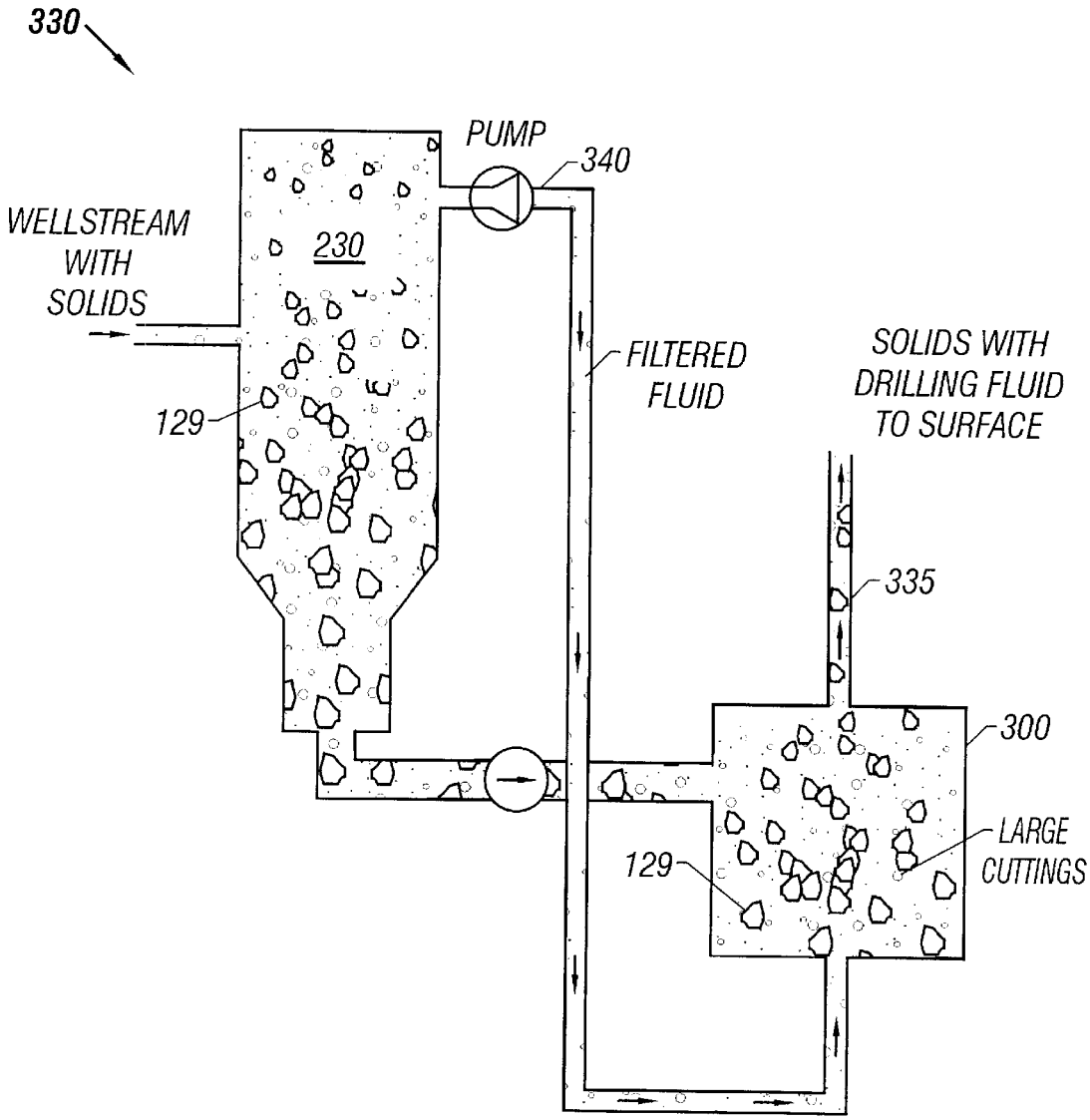
FIG. 5 is a schematic diagram of a system wherein an underwater separator separates solid mass from the wellstream and a common pump transports the filtered drilling fluid and the separated solids to the surface.

FIG. 5 shows an alternative system 330 of transporting solid mass 129 collected in the storage unit 300 of FIG. 4.

In this system, the filtered drilling fluids from separator 230 is pumped into the solid mass storage unit 300 to hydraulically lift and transport the solids 129 to the surface via a line 335. In this system, the same single pump 340 may be used to transport the filtered fluid by the separator 230 and the separated, but uncrushed, solids to the surface. This system does not require the use of a subsea crusher and also enables the pump to pump only the filtered drilling fluid. Furthermore, the same pump may be used to transport both the drilling fluid and the solids of all sizes and density to the surface.

Figure 6:
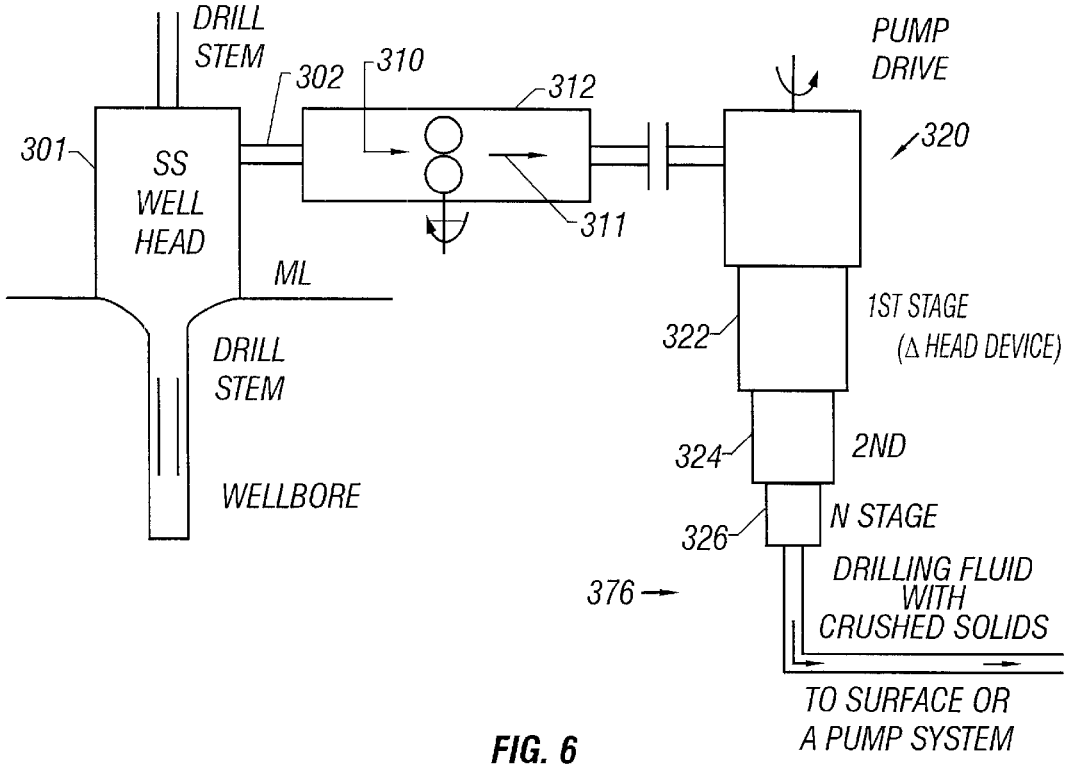
FIG. 6 is a schematic diagram of a system wherein a crusher reduces the size of solids and a serially coupled pump system pumps the drilling fluid and the reduced solids to the surface.

FIG. 6 shows a schematic diagram of an alternative embodiment for subsea processing of drilling fluid with solids 310 returning from the subsea wellbore. The fluid 310 from the wellhead 301 first passes via a line 302 into a crusher or pulverizer 312, wherein the larger solids are reduced to small sizes. The fluid with small solid particles 311 passes to a subsea pump system 320 which may include one or more stages in series. The pump system 320 is shown to include three successive stages 322, 324 and 326. The pump system 320 pumps the drilling fluid 311 either to the surface or to a second pump system (not shown). The number of pump stages and the pump systems utilized depends upon the differential pressure that must be overcome to move the fluid 311 to the surface.

Figure 7:
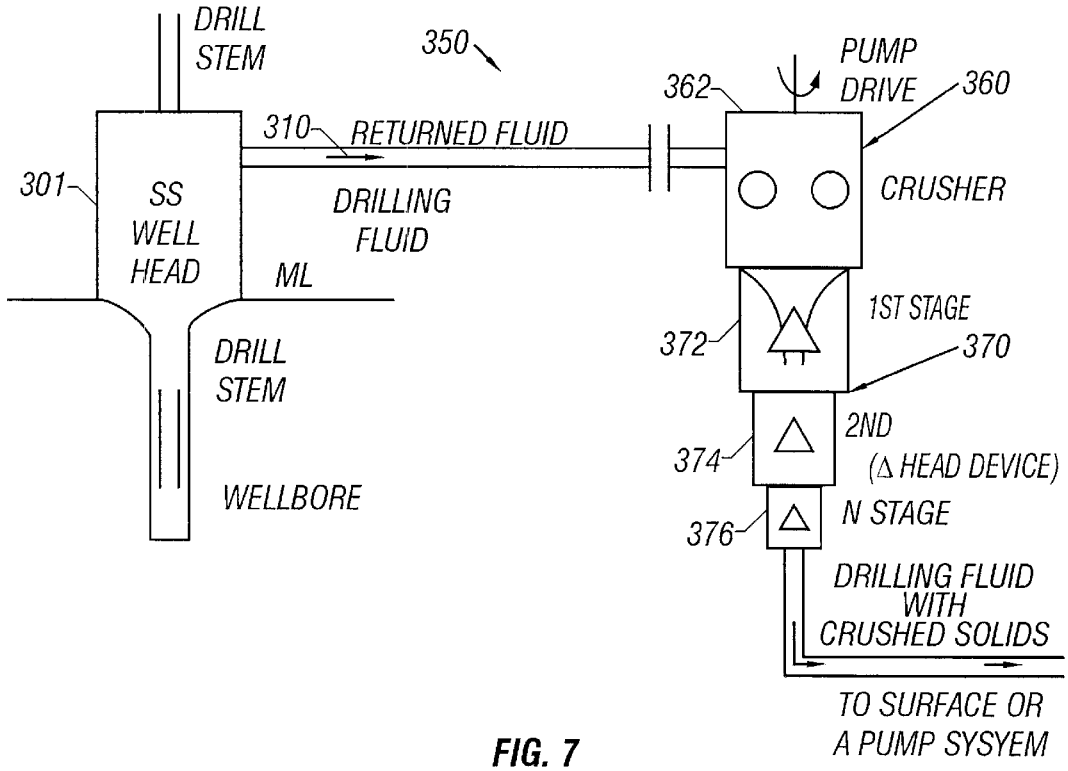
FIG. 7 is a schematic diagram of a system wherein the crusher and pump system form an integral unit.

FIG. 7 shows a schematic diagram of a return fluid processing system 350 that contains an integrated crusher and pump system. The drilling fluid containing all solids 310 passes into a suction chamber 362 that shears the large/heavier solids into small solids. The small solids along with the fluid pass into a pump unit 370 that may include one or more stages. The pump unit 370 is shown to include three stages, each such stage pumping the fluid to the next stage. The fluid with solids from the last stage 376 is pumped to the surface or to another pump unit (not shown). The system of FIGS. 6 and 7 eliminates the separators such as shown in FIGS. 1–5.

Referring back to FIG. 1, the system 100 of the present invention includes a controller or control unit 260 at the surface which controls the operation of various devices in the system 100. The system also includes a plurality of sensors which provide measures of certain parameters of interest of the system 100. Pressure sensors, level sensors, flow rate sensors or any other desired sensors may be provided in the separator 130. Such sensors are generally denoted by numeral 252. Sensors such as pressure sensors, flow rate sensors, etc. may also be provided in various fluid lines in the system 100. Such sensors are generally denoted by numeral 265. The sensor measurements are provided to the controller 260 which computes the values of the appropriate parameter of interest and controls the operation of one or more devices in the system 100. The arrows 257 leaving the sensors indicate that sensor signals are transmitted to the controller 260 while arrows 258 entering devices 290 indicate that the controller 260 provides signals to such devices to control their operation. The controller 260, for example, may control valves 270, 271, etc. in fluid lines to control the fluid flow into and/or out of the separator 230. The controller 260 may also control the speed of each of the pumps 140, 144, 280, 340 in the system 100 and the operation of the pulverizer 240 and 136.

Thus, the present invention provides a system 100 to control the particle size and methods of disposition of the solid mass in the wellstream at or adjacent the seabed, wherein a controller at the surface may control the operation of the various devices in the system in response to measurements made by one or more sensors relating to one or more parameters of interest of the system 100.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed:

1. An apparatus for processing drilling fluid including solids therein (the "return fluid") received at a subsea wellhead during drilling of a subsea wellbore, comprising:

(a) a subsea separator receiving said return fluid from the wellbore and separating at least solids from the drilling fluid; and (b) a subsea device associated with said separator reducing size of the separated solids below a predetermined size.

2. The apparatus according to claim 1 further comprising a first subsea pump for pumping fluid from the separator to a surface location and a second subsea pump for pumping solids reduced by the device.

3. The apparatus according to claim 1 further comprising a common pump for pumping the drilling fluid from the separator and the solids reduced by said subsea device to a surface location.

4. The apparatus according to claim 3, wherein the separator includes a selectively operable valve for discharging the separated solids to said pump.

5. The apparatus according to claim 2 further comprising a surface separator at the surface location for separating solids from fluid pumped to the surface.

6. The apparatus according to claim 1, wherein the subsea device reduces the size of the separated solids to a size that can be pumped to the surface by a subsea pump.

7. The apparatus according to claim 1, wherein the subsea device includes a plurality of cooperating crushing members to reduce size of the separated solids.

8. The apparatus according to claim 1, wherein the subsea device is one of (i) mechanically-operated; (ii) electromechanical; (iii) hydraulically-operated; and (iv) pneumatically-operated.

9. The apparatus according to claim 1, wherein the separator comprises:

(i) a vessel having an inlet for receiving the drilling fluid;

(ii) a conical section for housing separated solids from the drilling fluid, said conical section having a discharge port of sufficient size to discharge the separated solids from the conical section; and (iii) a control valve for opening the discharge port of the conical section to selectively discharge the separated solids from the vessel to the device.

10. The apparatus according to claim 4, wherein the subsea device is remotely-operable from the surface.

11. The apparatus according to claim 1 further comprising at least one sensor for providing a measure of a parameter of interest relating to said apparatus.

12. The apparatus according to claim 11, wherein the at least one sensor is selected from a group of sensors consisting of a: (i) level sensor; (ii) pressure sensor; and (iii) flow rate sensor.

13. The apparatus according to claim 12 further comprising a controller for controlling the operation of the apparatus in response to the measured parameter of interest.

14. An apparatus for processing drilling fluid including solids therein received at a subsea wellhead during drilling of a subsea wellbore, comprising:

(a) a subsea separator separating solids from said drilling fluid into a container; and (b) a pump for pumping the drilling fluid from the separator to the container, whereby the pumped drilling fluid moves the solids from the container to a surface location.

15. A method for processing drilling fluid and solid mixture received at a subsea wellhead during drilling of a subsea wellbore, comprising:

(a) separating the solids and drilling fluid from the mixture and discharging said separated solids into a container; and (b) transporting the separated solids to a surface location.

16. The method of claim 15, wherein transporting the separated solids comprises transporting the container to the surface location.

17. The method of claim 15, wherein transporting the separated solids comprises pumping the separated drilling fluid into the container to move the separated solids to the surface location via a suitable conduit.

18. An apparatus for processing a mixture of drilling fluid and solids received at a subsea wellhead during drilling of a wellbore, comprising:

(a) a device receiving the mixture and reducing the size of the solids; and (b) at least one pump receiving the drilling fluid and the reduced sized solids and pumping said received drilling fluid with the reduced sized solids to a surface location.

19. The apparatus according to claim 18, wherein the at least one pump includes a plurality of pumping stages.

20. A method of processing mixture of drilling fluid and solids received at a subsea wellhead during drilling a subsea wellbore, comprising:

(a) separating solids of sizes greater than a first predetermined size from said mixture; and (b) transporting said separated solids to a surface location.

21. The method of claim 20 further comprising reducing size of the separated solids to a size smaller than a second predetermined size by a subsea crusher before transporting said solids to the surface location.

22. The method according to claim 21, wherein transporting said solids comprises pumping said reduced size solids to a surface location of a subsea pump.

23. The method according to claim 21 further comprising pumping the reduced size solids and the drilling fluid to a surface location by a common subsea pump.

24. The apparatus of claim 18 wherein the device and the at least one pump are integrated.

25. The apparatus of claim 18 wherein the pump pumps the drilling fluid and reduced size solids to one of a surface location and a second pump system.

26. The apparatus of claim 18 wherein the device is adapted to shear larger solids into small solids.

27. A method for processing drilling fluid and solid mixture received at a subsea wellhead during drilling of a subsea wellbore, comprising:

(a) transporting the drilling fluid and solid mixture from the well head to a first device;

(b) reducing the size of the solids using the first device; and (c) pumping the drilling fluid and reduced size solids to a surface location using a first pump.

28. The method of claim 27 further comprising integrating the first device with the first pump.

29. The method of claim 27 further wherein pumping is accomplished by also using a second pump system.

30. The method of claim 27 further comprising shearing larger solids into small solids.

31. The method of claim 27 wherein the solids are reduced below a predetermined size.

32. The method of claim 27 wherein the drilling fluid and solids do not flow into a separator during said transporting step.

33. A system for drilling a well bore in a subsea formation, comprising:

(a) a rig positioned on a platform at a water surface;

(b) a tubing string suspended from said rig, said tubing string having an end on which is provided a drilling assembly adapted to form the well bore;

(c) a drilling fluid source on said platform for supplying drilling fluid, said drilling fluid exiting from said drilling assembly during drilling and returning up the well bore with solids;

(d) a device for receiving said drilling fluid and solids, said device reducing the size of said solids; and (e) at least one pump receiving said drilling fluid and reduced size solids and pumping said received drilling fluid with said reduced sized solids to a surface location.

34. The system of claim 33 wherein said device and said at least one pump are integrated.

35. The system of claim 33 wherein said pump pumps said drilling fluid and reduced size solids to one of a surface location and a second pump system.

36. The system of claim 33 wherein said device is adapted to shear larger solids into small solids.

37. The system of claim 33 wherein said device reduces said solids below a predetermined size.

38. The system of claim 33 wherein said device reduces the size of said solids to a size that can be pumped to said surface location by said at least one pump.

39. The system of claim 33 wherein said device includes a plurality of cooperating crushing members to reduce the size of said solids.

* * * * *